US012222142B2

(12) United States Patent
Tian et al.

(10) Patent No.: US 12,222,142 B2
(45) Date of Patent: Feb. 11, 2025

(54) AIR CONDITIONER AND RESERVOIR THEREOF

(71) Applicant: ZHEJIANG DUNAN ARTIFICIAL ENVIRONMENT CO., LTD., Shaoxing (CN)

(72) Inventors: Peng Tian, Shaoxing (CN); Hailong Zhong, Shaoxing (CN); Feida Li, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 439 days.

(21) Appl. No.: 17/727,799

(22) Filed: Apr. 24, 2022

(65) Prior Publication Data

US 2022/0243969 A1 Aug. 4, 2022

Related U.S. Application Data

(63) Continuation of application No. PCT/CN2020/109702, filed on Aug. 18, 2020.

(30) Foreign Application Priority Data

Oct. 29, 2019 (CN) ..... 201921871745.X

(51) Int. Cl.
*F25B 43/00* (2006.01)
*F25B 39/02* (2006.01)

(52) U.S. Cl.
CPC ..... *F25B 43/006* (2013.01); *F25B 39/02* (2013.01)

(58) Field of Classification Search
CPC ..... F25B 43/006; F25B 39/02; F25B 43/00; F25B 43/02
USPC ..... 62/503
See application file for complete search history.

(56) References Cited

U.S. PATENT DOCUMENTS

| | | | | |
|---|---|---|---|---|
| 2,354,297 | A * | 7/1944 | Ayres | B65D 55/12 292/7 |
| 3,938,353 | A | 2/1976 | Wrenn, Jr. et al. | |
| 9,982,417 | B1 * | 5/2018 | Humble | E03B 1/042 |
| 2006/0280622 | A1 * | 12/2006 | Lee | F25B 43/02 417/313 |
| 2009/0108717 | A1 * | 4/2009 | Jang | F24F 1/50 312/100 |
| 2016/0010882 | A1 * | 1/2016 | Lee | A47B 81/00 312/236 |

FOREIGN PATENT DOCUMENTS

| | | | |
|---|---|---|---|
| CN | 101256041 | A * | 9/2008 |
| CN | 202757361 | U | 2/2013 |
| CN | 205825524 | U | 12/2016 |

(Continued)

OTHER PUBLICATIONS

International Search Report of PCT/CN2020/109702.

*Primary Examiner* — Steve S Tanenbaum

(57) ABSTRACT

The present disclosure relates to an air conditioner and a reservoir thereof. The reservoir includes a tank and a base component. The tank has opposite top and bottom ends. The base component includes a bottom plate arranged in a flat plate shape and a supporting member protruding from the bottom plate. The bottom plate has a bearing surface, the supporting member is fixed on the bearing surface, and an end away from the bottom plate of the supporting member is fixedly connected to the bottom end.

16 Claims, 5 Drawing Sheets

(56) References Cited

FOREIGN PATENT DOCUMENTS

| | | | |
|---|---|---|---|
| CN | 208588123 | U | 3/2019 |
| JP | H9-138040 | A | 5/1997 |

* cited by examiner

AIR CONDITIONER AND RESERVOIR THEREOF

CROSS-REFERENCE TO RELATED APPLICATION

This application is a continuation of international application No. PCT/CN2020/109702 filed on Aug. 18, 2020, which claims all benefits accruing from China Patent Application No. 201921871745.X, filed on Oct. 29, 2019, titled "AIR CONDITIONER AND RESERVOIR THEREOF" in the China National Intellectual Property Administration, the content of which is hereby incorporated by reference.

TECHNICAL FIELD

The present disclosure generally relates to a refrigeration device, and in particular, to an air conditioner and a reservoir thereof.

BACKGROUND

A reservoir plays a role of storage, gas-liquid separation, filtration, and refrigerant buffer in a freezing and refrigerating process. The reservoir is arranged between an evaporator and a suction tube of a compressor. The reservoir is a protective member to prevent refrigerant in liquid form from flowing into the compressor and producing liquid shock. In order to improve corrosion resistance of the reservoir, an outer surface of the reservoir is usually coated with paint. In general, the reservoir can include a base and a tank. The base is a U-shaped bent plate defined by bending two opposite sides towards the tank, and a bottom of the tank is fixed on the two sides.

However, due to a small space between the bottom of the tank and the base, there is a dead spot when painting the tank surface because the bottom of the tank is partially blocked by the base, resulting in the tank that is poorly painted in places where there is no paint film or the paint film is not thick enough, thus affecting the corrosion resistance of the reservoir. As a result, when the reservoir is used for a long time, the tank may easily rust, further causing the tank to leak and greatly affecting the reliability of the tank when used.

SUMMARY

It is desired to provide an air conditioner and a reservoir thereof with high reliability to solve the above problem.

The reservoir includes a tank and a base component. The tank has a top end and an opposite bottom end. The base component includes a bottom plate arranged in a tabular shape and a supporting member protruding from the bottom plate. The bottom plate has a bearing surface, the supporting member is fixed on the bearing surface of the bottom plate, and an end away from the bottom plate of the supporting member is fixedly connected to the bottom end.

In an embodiment of the present disclosure, the tank includes a tube which is hollow, an inlet pipe, and an outlet pipe. An end of the tube is fixed to the bearing surface of the bottom plate, and a sidewall away from the bottom plate of the tube is provided with an inlet and an outlet which are spaced apart. The inlet pipe and the outlet pipe are in communication with and fixed to the tube. A first end of the inlet pipe extending through the inlet is located in the tube and a second end of the inlet pipe is located out of the tube.

A first end of the outlet pipe extending through the outlet is located in the tube and a second end of the outlet pipe is located out of the tube.

In an embodiment of the present disclosure, in a surface parallel to the bearing surface, a size of the supporting member decreases gradually along a direction from the bottom end to the top end of the tank.

In an embodiment of the present disclosure, a surface of an end away from the bottom plate of the supporting member abuts against a surface of the bottom end of the tank.

In an embodiment of the present disclosure, the bottom plate is provided with a mounting hole.

In an embodiment of the present disclosure, a plurality of reinforcement bars protruding along a direction from the bottom end to the top end of the tank are disposed on the bearing surface of the bottom plate.

In an embodiment of the present disclosure, a projection of the reinforcement bar on the bearing surface along a direction perpendicular to the bearing surface is within the bearing surface.

In an embodiment of the present disclosure, the bottom plate is provided with a coating hole penetrating through the bottom plate, and the supporting member is disposed at an edge of the coating hole along a circumference of the coating hole.

In an embodiment of the present disclosure, the supporting member is defined by the edge of the coating hole being folded towards the bottom of the tank.

An air conditioner includes the reservoir, an evaporator connected with and being in communication with the inlet pipe, and a compressor connected with and being in communication with the outlet pipe.

BRIEF DESCRIPTION OF THE DRAWINGS

To describe and illustrate embodiments and/or examples of the present disclosure made public here better, reference may be made to one or more of the figures. The additional details or examples used to describe the figures should not be construed as limiting the scope of any of the present disclosure, the embodiments and/or examples currently described, and the best model of the present disclosure as currently understood.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without making creative labor are the scope of the present disclosure.

It should be noted that when an element is considered to be "fixed to" another element, it can be directly fixed to another element, or there can be a centered element. When an element is considered to be "connected to" another element, it can be directly connected to another element, or there can be a centered element at the same time. The terms "vertical", "horizontal", "left", "right" and similar expressions are used herein for illustrative purposes only.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

Figure 6:
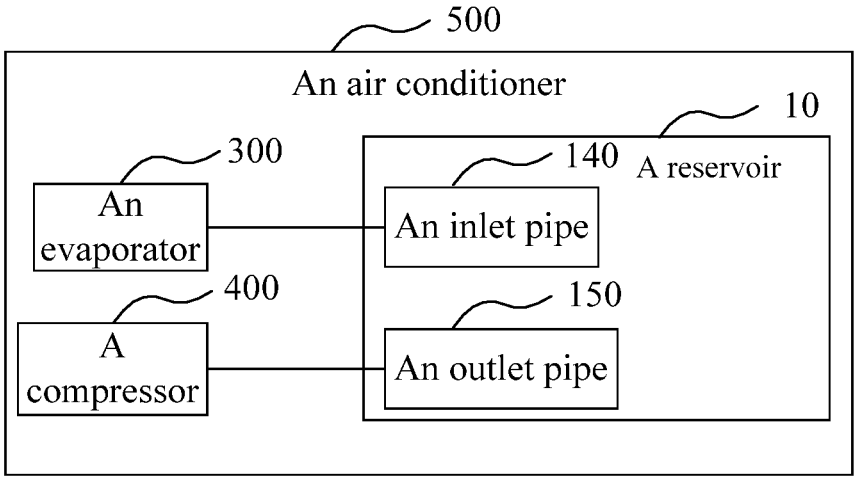
FIG. 6 is a schematic diagram of an air conditioner in an embodiment of the present disclosure.

Referring to FIG. 6, an air conditioner 500 and a reservoir 10 thereof can be provided in the present disclosure. The air conditioner 500 can include the reservoir 10, an evaporator 300, and a compressor 400.

The reservoir 10 can communicate the evaporator 300 with the compressor 400, which can be a protective member to prevent refrigerant in liquid form from flowing into the compressor 400 and producing liquid shock. During operation of the air conditioner 500, the refrigerant cannot be completely vaporized. When the refrigerant comes out from the evaporator 300, the refrigerant in liquid form can enter the reservoir 10. As the refrigerant in liquid form is heavier than a gas, the refrigerant in liquid form can directly accumulate at the bottom of the reservoir 10. Refrigerant in vapor form in the reservoir 10 can directly enter into the compressor 400, thus preventing the compressor 400 from liquid shock caused by an intake of the refrigerant in liquid form.

Figure 1:
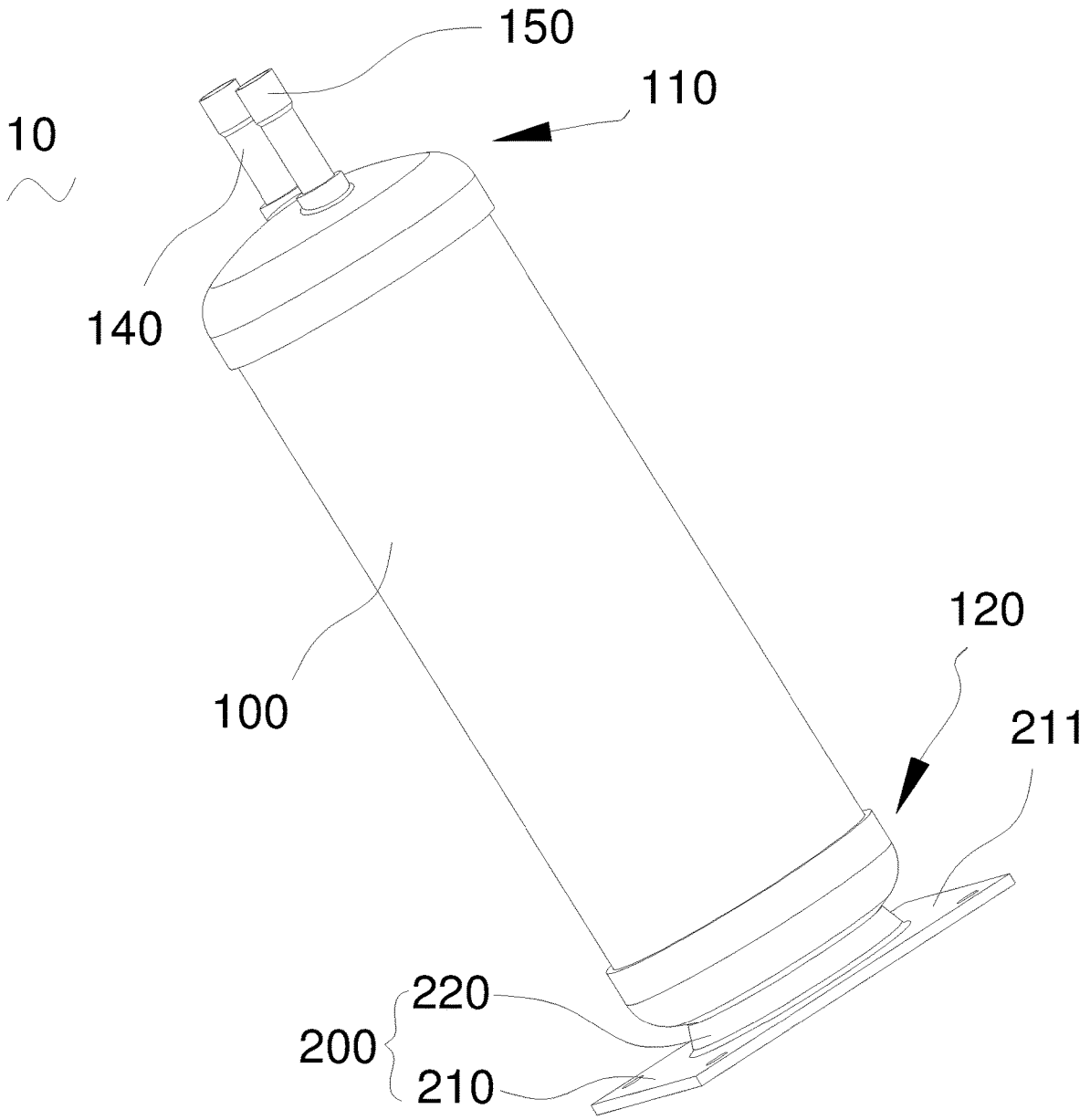
FIG. 1 is a schematic diagram of a reservoir in an embodiment of the present disclosure.
Figure 2:
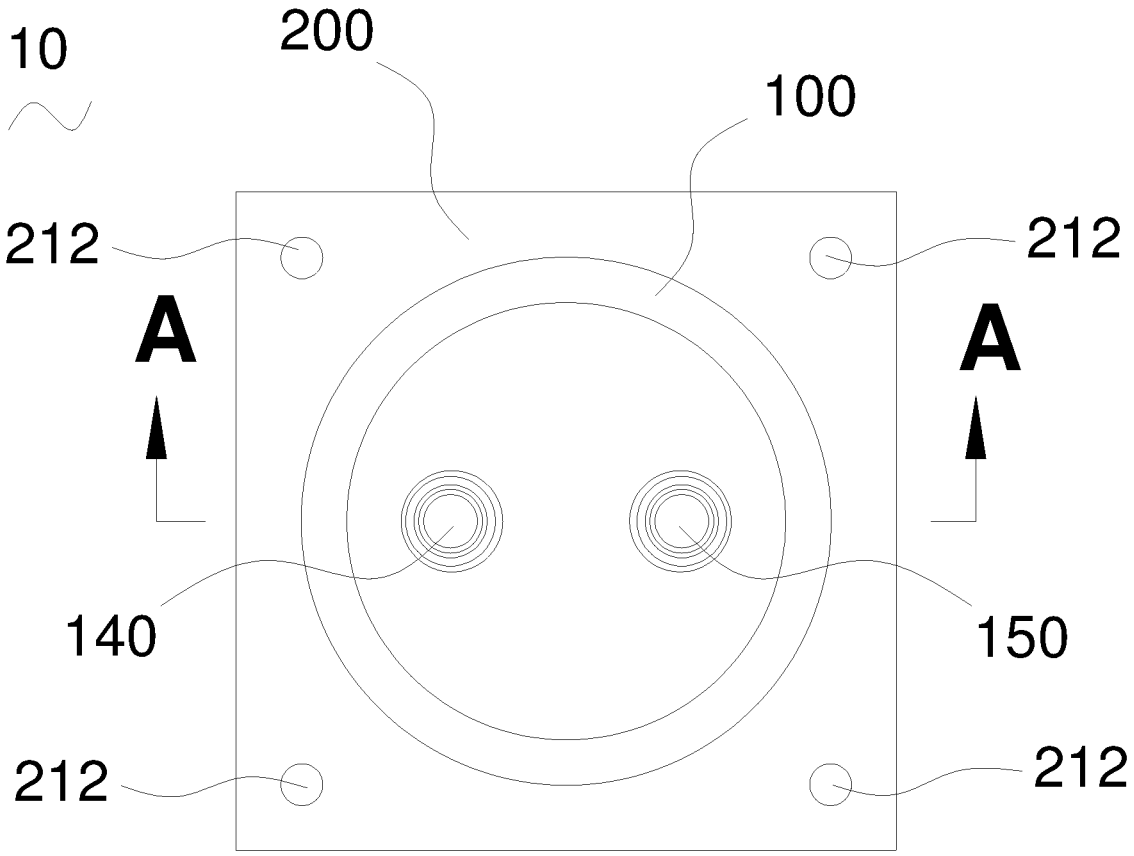
FIG. 2 is a top view of the reservoir of FIG. 1.

Referring to FIG. 1, the reservoir 10 in an embodiment of the present disclosure can include a tank 100 and a base component 200.

The tank 100 can include a top end 110 and an opposite bottom end 120. When the tank 100 is on a horizontal plane, the top end 110 is defined as an upper end of the tank 100, and the bottom end 120 is defined as a lower end of the tank 100. In the air conditioner 500, the tank 100 can be communicated between the evaporator 300 and the compressor 400 and can be a core component of the reservoir 10. When the air conditioner 500 is in operation, both the refrigerant in vapor form and the refrigerant in liquid form can flow into the tank 100. The refrigerant in liquid form can accumulate in the tank 100 due to gravity of the refrigerant itself, while the refrigerant in vapor form can flow out of the tank 100.

Figure 3:
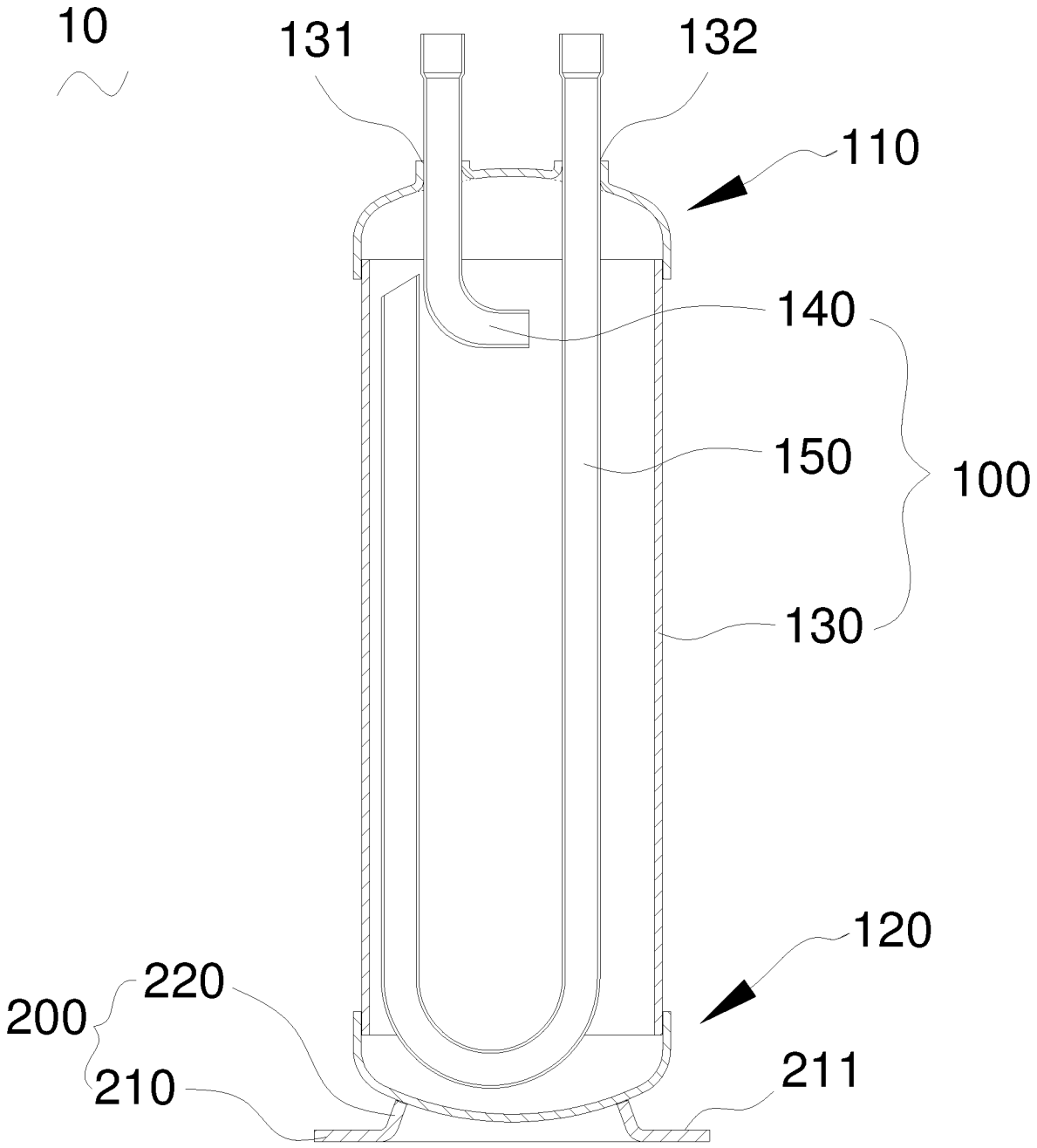
FIG. 3 is a sectional diagram of the reservoir of FIG. 2 along a A-A line.

Referring together to FIG. 3, in an embodiment, the tank 100 can include a tube 130 which is hollow, an inlet pipe 140, and an outlet pipe 150. The top end 110 of the tube 130 can be provided with an inlet 131 and an outlet 132 which are separated from each other. The inlet pipe 140 and the outlet pipe 150 can be in communication with and fixed to the tube 130. A first end of the inlet pipe 140 extending through the inlet 131 can be located in the tube and a second end of the inlet pipe 140 can be located out of the tube. A first end of the outlet pipe 150 extending through the outlet 132 is located in the tube 130 and a second end of the outlet pipe 150 can be located out of the tube 130.

In the air conditioner 500, the second end located out of the tube 130 of the inlet pipe 140 can be connected to the evaporator 300, and the second end located out of the tube 130 of the inlet pipe 140 can be connected to the compressor 400. In an actual operating process, after coming out from the evaporator 300, the refrigerant can flow into the tube 130 via the inlet pipe 140. At this moment, the refrigerant in liquid form can accumulate at the bottom of the tube 130 due to the gravity of the refrigerant itself, while the refrigerant in vapor form can flow directly into the compressor 400 via the outlet pipe 150.

Figure 4:
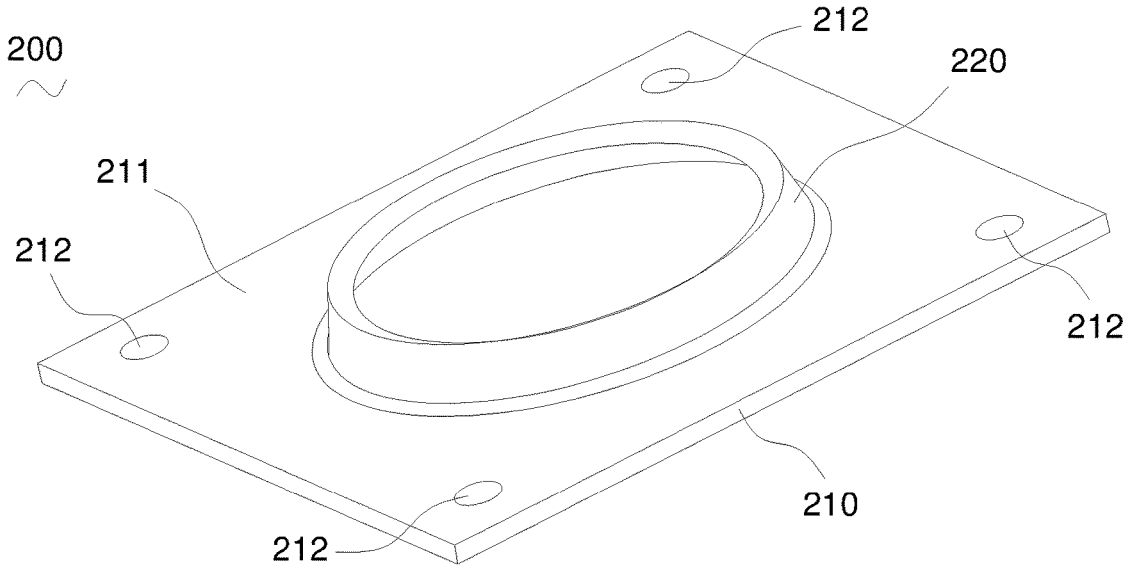
FIG. 4 is a schematic diagram of a base component in the reservoir of FIG. 1.

Referring together to FIG. 4, the base component 200 can include a bottom plate 210 arranged in a tabular shape and a supporting member 220 in a columnar shape protruding from the bottom plate 210. The bottom plate 210 has a bearing surface 211. When the reservoir 10 is in an operating position, the bearing surface 211 is defined as an upper surface of the bottom plate 210. The supporting member 220 is provided on the bearing surface 211. An end away from the bottom plate 210 of the supporting member 220 is fixedly connected to the bottom end 120 of the tank 100. Thus, the base component 200 can mainly play a role of supporting, and the base component 200 can be made of materials having relatively great strength such as a stainless steel, an alloy steel and the like, resulting in that the base component 200 can have sufficient bearing capacity. A cross-section of the bottom plate 210 can be in a circular shape, a rectangular shape, a polygonal shape, or a special shape, etc. Referring to FIG. 3 and FIG. 4, the supporting member 220 can be in a hollow columnar-shaped structure such that an annular-shaped fixation area is defined between the supporting member 220 and the bottom end 120 of the tank 100. In other embodiments, the supporting member 220 can be in a solid columnar-shaped structure. In addition, a cross-section of the supporting member 220 along a direction from the top end 110 to the bottom end 120 can be in a rectangular shape, or a trapezoidal shape, etc. The supporting member 220 can be fixedly connected to the bottom plate 210 by a welding process and the like, or the supporting member 220 can be integrally formed with the bottom plate 210 by stamping and bending, casting or other processes. In the air conditioner 500, the bottom plate 210 is fixedly connected to other members in the air conditioner 500 to install the reservoir 10.

Specifically, an end of the tube 130 can be fixed to the bearing surface 211. A sidewall away from the bottom plate 210 of the tube 130 can be provided with the inlet 131 and the outlet 132. When the reservoir 10 is on the horizontal plane, the inlet 131 and the outlet 132 are located at the upper end of the tube 130. Thus, the refrigerant in liquid form that flows into the tube 130 via the inlet 131 can directly fall to the bottom in the tube 130, which can prevent the refrigerant in liquid form in the tube 130 from flowing out via the inlet 131 and the outlet 132, further improving reliability of the reservoir 10.

In the present embodiment, the bottom plate 210 can be provided with a mounting hole 212. In an assembly process of the air conditioner 500, the reservoir 10 can be installed on the other members of the air conditioner 500 by penetrating connecting members such as screws, bolts and the like through the mounting hole 212 and fixedly connected to the other members of the air conditioner 500. Therefore, an arrangement of the mounting hole 212 is convenient for the installation of the reservoir 10. Specifically, in order to improve a fixing effect between the bottom plate 210 and the other members of the air conditioner 500, the bottom plate 210 can be provided with a plurality of mounting holes 212 which are separated from each other.

Figure 5:
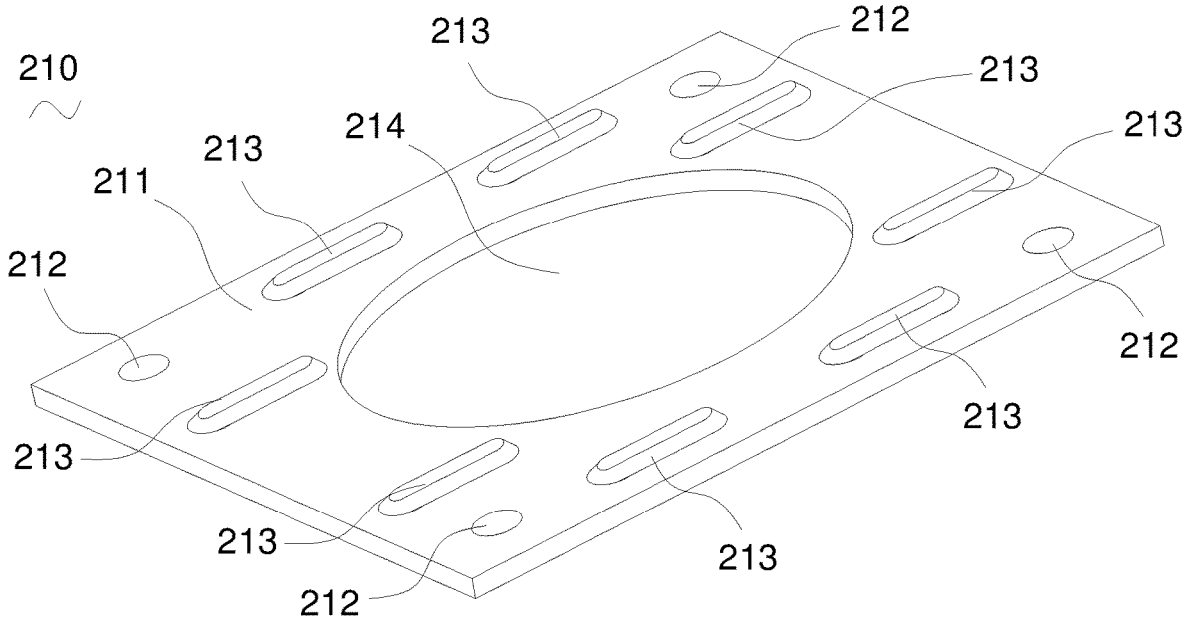
FIG. 5 is a schematic diagram of a bottom plate in the base component of FIG. 4.

Referring together to FIG. 5, in the present embodiment, the bottom plate 210 can be further provided with a plurality of reinforcement bars 213 protruding from the bearing surface 211. In some embodiments, the reinforcement bars 213 can be formed by stamping from a side of the bottom plate 210 back away from the bearing surface 211 with a stretching die, etc., so as to form a convex bar structure protruding from the bearing surface 211. In other embodiments, the reinforcing bars 213 can further be a structure integrally formed on the bottom plate 210 by welding or casting. The arrangement of the reinforcement bars 213 can effectively increase strength of the bottom plate 210, avoid the bottom plate 210 from breaking and deforming during use, effectively extend a service life of the bottom plate 210, and further extend a service life of the reservoir 10. At the same time, since the reinforcement bars 213 can project to a side of the bearing surface 211, the arrangement of the reinforcement bars 213 would not affect flatness of a surface back away from the bearing surface 211 of the bottom plate 210, so that it is conducive to a fixed connection between the bottom plate 210 and other members of the air conditioner 500.

A projection of the reinforcement bars 213 on the bearing surface 211 along a direction from the top end 110 to the bottom end 120 can be within the bearing surface 211. Thus, the reinforcement bars 213 can be not in contact with edges of the bottom plate 210, or do not cover two opposite edges of the bottom plate 210, further reducing a probability of breaking, bending and deforming of the bottom plate 210 during use, and further extending the service life of the bottom plate 210.

During a coating process of a paint film, because the bottom end 120 of the tank 100 can be fixed to the end away from the bottom plate 210 of the supporting member 220, there is a large operating space between the tank 100 and the bottom plate 210. Therefore, a position where the tank 100 is not in contact with the supporting member 220 can be exposed to the outside without a block, facilitating coating operation of the paint film, greatly improving a coating effect of the paint film at the bottom end 120 of the tank 100, and reducing a probability of leakage of the tank 100 due to rust caused by poor coating of the paint film. Therefore, an application of the base component 200 can effectively improve the reliability of the reservoir 10.

Referring to FIG. 1, FIG. 3 and FIG. 4 again, in the present embodiment, in a surface parallel to the bearing surface 211, a size of the supporting member 220 can gradually decrease along a direction from the bottom end 120 to the top end 110. Thus, a cross-section of the supporting member 220 along a longitudinal direction is in a conical-shape with a small top and a large bottom, stability of the conical-shaped can effectively improve supporting stability of the supporting member 220 to the tank 100.

In the present embodiment, a surface of the end away from the bottom plate 210 of the supporting member 220 can abut against a surface of the bottom end 120. Thus, the end away from the bottom plate 210 of the supporting member 220 can be in full contact with the surface of the bottom end 120 of the tank 100, the tank 100 can be more stable on the supporting member 220, and a fixation between the supporting member 220 and the tank 100 can be more effective.

Referring to FIG. 4, and FIG. 5 again, in the present embodiment, the bottom plate 210 can be provided with a coating hole 214 penetrating through the bottom plate 210. The supporting member 220 can be disposed at an edge of the coating hole 214 along a circumference of the coating hole 214. Thus, the supporting member 220 has a cross-section in a circular shape parallel to the bearing surface 211. Therefore, the bottom of the tank 100 can include three portions, one of which can be in the supporting member 220, another portion can be located outside the supporting member 220, and the other portion can be in direct contact with the surface of the end away from the bottom plate 210 of the supporting member 220. When the paint film is coated on the tank 100, the paint film can be coated on the tank 100 located outside the supporting member 220 from the end of the bottom plate 210 having the bearing surface 211, or the coating can be coating on a bottom of an outer surface of the bottom end 120 of the tank 100 via the coating hole 214 from the side of the bottom plate 210 away from the bearing surface 211. Therefore, arrangement of the coating hole 214 and the supporting member 220 along the circumference of the coating hole 214 can ensure the fixation effect between the supporting member 220 and the tank 100, while increasing an area for effective coating on the outer surface of the tank 100, further reducing the probability of the tank 100 leaking due to rust caused by poor paint coating, and further improving the reliability of the reservoir 10.

Furthermore, in the present embodiment, the supporting member 200 can be defined by the edge of the coating hole 214 being folded towards the tank 100. Specifically, the supporting member 220 can be defined by stamping the edge of the coating hole 214 towards the tank 100 with a stamping equipment. Thus, the supporting member 220 and the bottom plate 210 can be integrally formed, resulting in that a connection between the supporting member 220 and the bottom plate 210 can be more solid and a processing of the base component 200 can be easier.

The above air conditioner 500 and the reservoir 10 thereof have advantages as follows. During the coating process of the paint film, because the bottom end 120 of the tank 100 can be fixed to the end away from the bottom plate 210 of the supporting member 220, there is a large operating space between the tank 100 and the bottom plate 210. Therefore, the position where the tank 100 is not in contact with the supporting member 220 can be exposed to the outside without a block, facilitating coating operation of the paint film, greatly improving a coating effect of the paint film at the bottom end 120 of the tank 100, and reducing the probability of leakage of the tank 100 due to rust caused by poor coating of the paint film. Therefore, the application of the base component 200 can effectively improve the reliability of the reservoir 10, thereby the air conditioner 500 can be more reliable.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A reservoir comprising:

a tank having a top end and an opposite bottom end; and a base component comprising a bottom plate arranged in a tabular shape and a supporting member protruding from the bottom plate, wherein the bottom plate has a bearing surface, the supporting member is fixed on the bearing surface of the bottom plate, and an end away from the bottom plate of the supporting member is fixedly connected to the bottom end of the tank.

2. The reservoir of claim 1, wherein the tank comprises a tube which is hollow, an inlet pipe, and an outlet pipe;

an end of the tube is fixed to the bearing surface of the bottom plate, and a sidewall away from the bottom plate of the tube is provided with an inlet and an outlet which are separated from each other;

the inlet pipe and the outlet pipe are in communication with and fixed to the tube, wherein a first end of the inlet pipe extending through the inlet is located in the tube and a second end of the inlet pipe is located out of the tube, a first end of the outlet pipe extending through the outlet is located in the tube and a second end of the outlet pipe is located out of the tube.

3. The reservoir of claim 1, wherein in a surface parallel to the bearing surface, a size of the supporting member decreases gradually along a direction from the bottom end to the top end of the tank.

4. The reservoir of claim 1, wherein the bottom plate is provided with a mounting hole.

5. The reservoir of claim 1, wherein a plurality of reinforcement bars protruding along a direction from the bottom end to the top end of the tank are disposed on the bearing surface of the bottom plate.

6. The reservoir of claim 5, wherein a projection of the plurality of reinforcement bars on the bearing surface along a direction perpendicular to the bearing surface is within the bearing surface.

7. The reservoir of claim 1, wherein the bottom plate is provided with a coating hole penetrating through the bottom plate, and the supporting member is disposed at an edge of the coating hole along a circumference of the coating hole.

8. The reservoir of claim 7, wherein the supporting member is defined by the edge of the coating hole, which is folded towards the bottom end of the tank.

9. An air conditioner comprising:

the reservoir of claim 1;

an evaporator connected with and being in communication with the inlet pipe; and a compressor connected with and being in communication with the outlet pipe.

10. The reservoir of claim 9, wherein the tank comprises a tube which is hollow, an inlet pipe, and an outlet pipe;

an end of the tube is fixed to the bearing surface of the bottom plate via the supporting member, and the top end of the tube away from the bottom plate is provided with an inlet and an outlet which are separated from each other;

the inlet pipe and the outlet pipe are in communication with and fixed to the tube, wherein a first end of the inlet pipe extending through the inlet is located in the tube and a second end of the inlet pipe is located out of the tube, a first end of the outlet pipe extending through the outlet is located in the tube and a second end of the outlet pipe is located out of the tube.

11. The reservoir of claim 9, wherein a surface of the end of the supporting member away from the bottom plate abuts against a surface of the bottom end of the tank.

12. The reservoir of claim 9, wherein the bottom plate is provided with a mounting hole.

13. The reservoir of claim 9, wherein a plurality of reinforcement bars protruding along a direction from the bottom end to the top end of the tank are disposed on the bearing surface of the bottom plate.

14. The reservoir of claim 13, wherein a projection of the plurality of reinforcement bars on the bearing surface along a direction perpendicular to the bearing surface is within the bearing surface.

15. The reservoir of claim 9, wherein the bottom plate is provided with a coating hole penetrating through the bottom plate, and the supporting member is disposed at an edge of the coating hole along a circumference of the coating hole.

16. The reservoir of claim 15, wherein the supporting member is defined by the edge of the coating hole, which is folded towards the bottom end of the tank.

* * * * *